US005685115A

United States Patent [19]

Colfer

[11] Patent Number: 5,685,115

[45] Date of Patent: Nov. 11, 1997

[54] INTEGRATED WALL SYSTEM

[76] Inventor: James D. Colfer, 2462 Lakeridge Shores East, Reno, Nev. 89509

[21] Appl. No.: 386,914

[22] Filed: Feb. 8, 1995

[51] Int. Cl.[6] ..... E02D 27/00

[52] U.S. Cl. ..... 52/292; 52/294; 52/299; 52/742.14

[58] Field of Search ..... 52/294, 299, 292, 52/236.6, 309.12, 742.1, 742.12, 742.13, 742.14, 742.5

[56] References Cited

U.S. PATENT DOCUMENTS

| | | | |
|---|---|---|---|
| 1,764,001 | 6/1930 | Blanchard | 52/299 |
| 2,067,403 | 1/1937 | Lea | 52/299 |
| 2,883,852 | 4/1959 | Midby | 52/299 X |
| 3,798,853 | 3/1974 | Castle | 52/299 X |
| 4,669,240 | 6/1987 | Amormino | 52/299 X |
| 4,930,278 | 6/1990 | Staresena | 52/600 X |
| 5,119,606 | 6/1992 | Graham | 52/600 X |

FOREIGN PATENT DOCUMENTS

| | | | |
|---|---|---|---|
| 777185 | 11/1980 | U.S.S.R. | 52/299 |

*Primary Examiner*—Carl D. Friedman
*Assistant Examiner*—Beth Aubrey
*Attorney, Agent, or Firm*—Nathan P. Koenig; Crosby, Heafey, Roach & May

[57] ABSTRACT

An integrated wall panel for building construction comprising a framing structure secured to a reinforced concrete stemwall. The framing structure comprises two vertical end studs and the stemwall comprises a mass of concrete surrounding reinforcing means and extending between lower portions of the studs. Additional framing members including horizontal framing members and intermediate studs are secured to the end studs and the stemwall. A mass of concrete surrounds the reinforcing means and fills the stemwall form, making an integral panel. Preferably, the concrete extends into a channel in the end studs to secure the stemwall to the end studs. The integrated wall system may be configured to receive floor joists or may have additional reinforcing rods extending perpendicularly from the panel to support a poured concrete floor. A method for producing the integrated panels comprises providing framing structures with end studs and secured reinforcing means and depositing concrete between the end studs and around the reinforcing means. Multiple panels may be formed at once by employing a jig having a series of parallel horizontal forming members secured to a platform. Each forming member is configured to receive the end studs of the framing structure so that three sides of the perimeter of the stemwall to be formed are defined. Buildings constructed with panels of this invention generally comprise a plurality of support piers. Each panel spans the distance between a pair of piers so that each end of the panel is supported.

19 Claims, 7 Drawing Sheets

INTEGRATED WALL SYSTEM

BACKGROUND OF THE INVENTION

A common and versatile method of building fabrication is the "stick built" construction, referring to a wood framed building. These buildings generally have a foundation, a continuous spread footing at the perimeter of the foundation, a stem wall built on the spread footing, a floor framing system and plywood subfloor supported by the stem wall and a wood framing wall system built on the perimeter of the floor framing system. Despite the versatility of the system, there are drawbacks associated with stick built construction. Each system represents a construction step which must be performed sequentially, requiting separate completion before the next step can be performed. The foundation and footing systems require extensive site preparation and the use of engineered fill. The price of wood continues to escalate while the quality decreases.

Another general class of building technique relates to the "tilt-up" of preformed concrete panels. For example, U.S. Pat. No. 4,901,491 to Phillips, which is incorporated in its entirety by reference, discloses a precast reinforced concrete wall panel with a flaring footer which is intended to obviate the need for a poured foundation. However, this system still requires careful preparation of the soil around the entire perimeter of the building. The unitary footer simulates a spread footing and may require engineered fill. Further, the concrete panels are heavy and costly while lacking the versatility of a framed structures. U.S. Pat. No. 2,883,852 to Midby, U.S. Pat. No. 3,685,241 to Cooper and U.S. Pat. No. 4,669,240 to Amormino, all of which are hereby incorporated in their entirety by reference, disclose other concrete panel structures and systems. They suffer from similar drawbacks in that they all require a continuous spread footing and lack the advantages of a framed structure.

Accordingly, there is need for an alternate, simplified construction technique which decreases and combines the discrete steps. There is a need for a technique which eliminates the requirement of continuous spread footing and separate stem wall while facilitating construction in poor or varying soil conditions. There is also a need for a technique which allows the use of a framed structure comprising materials other than wood, such as light gauge steel.

SUMMARY OF THE INVENTION

The invention comprises an integrated, pre-formed wall panel system for building construction. The panel is a framing structure secured to a reinforced concrete stemwall. In a basic embodiment, the framing structure comprises two vertical end studs and the stemwall comprises a mass of concrete surrounding reinforcing means and extending between lower portions of the studs. Additional framing members including horizontal framing members and intermediate studs may be added before or after formation of the stemwall and before or after the panel is erected at the building site. In preferred embodiments, the framing structure comprises one or more horizontal framing members or intermediate studs. Generally, a horizontal framing member connects the top ends of the end studs and a plurality of intermediate vertical studs spaced between the end studs extend from between the horizontal framing member and the stemwall. Additional framing configurations may be desirable, including framed window openings, door openings, conduits or other openings. In some embodiments a horizontal framing member borders the stemwall and is secured by anchor bolts and nuts or other suitable means.

The mass of concrete surrounds the reinforcing means and extends between the end studs, making an integral panel. The end studs may be attached to the stemwall in any suitable manner. Preferably, the end studs comprise C-studs with the channel facing the stemwall so that the concrete extends into the channel, securing the stud to the stemwall. Other means for securing the end studs to the stemwall may be used alternatively or in combination and include post tension cables, vertical- and horizontal-through bolts, anchor bolts, other imbedded metallic hardware and other reinforcing steel configurations.

The integrated wall system is preferably configured to support a particular flooring system. For example, the horizontal framing member bordering the stemwall or the stemwall itself, the end studs and the intermediate studs may be spaced and configured to support and secure conventional floor joists. In other embodiments, the stemwall comprises additional reinforcing reds extending perpendicularly from the panel so that a concrete floor may be poured around them.

This invention also comprises a method for producing the integrated panels. Framing structures comprising ends studs are provided and reinforcing means are positioned between the end studs. Concrete is deposited between the end studs and around the reinforcing means. Some framing structure embodiments will comprise a horizontal framing member positioned to border the top of the stemwall. Depending on the framing structure used, the additional dimensions of the stemwall, the bottom, the faces or the top, may be formed by conventional means, such as temporary plywood forms. Then, concrete is deposited into the cavity around the reinforcing means. Once the concrete sets, any temporary forms may be removed and the panel is ready for incorporation into a building.

Multiple panels may be formed at once by employing a jig having a series of parallel horizontal forming members secured to a platform. A plurality of framing structures having end studs and reinforcing means are provided. Each forming member is configured to receive the end studs of the framing structure so that three sides of the perimeter of the stemwall to be formed are defined. When placed in the horizontal forming members, the framing structures stand vertically and face each other. The forming members are spaced apart a distance such that a planar forming spacer can fit between each pair, thus defining the sides of the stemwall form. Concrete may be pumped into the stemwall form. In some embodiments, the framing structure has a horizontal framing member which comprises the upper boundary of the stemwall form and is fitted with a port so that concrete may be pumped into the stemwall form. Intermediate studs may be secured to the horizontal framing member or to the concrete itself. Once the concrete sets, the panels are removed from the jig and are ready for incorporation into a building.

A building constructed using the integrated wall panels and the corresponding process are also within the scope of this invention. Buildings of this invention generally comprise a plurality of support piers. Each panel spans the distance between a pair of piers so that each end of the panel is supported. Preferably, the support piers comprise a key way configured to receive the bottom edge of the stemwall.

The integrated wall system can be utilized throughout the building industry. Its uses are unlimited. Residential applications include, but are not limited to: single family, multi units, town houses, apartments, condominiums, pre-fab buildings, modular buildings, custom home garages, agricultural buildings and other residential dwellings. Commercial applications include offices, warehouses, storage units of all types, recreational facilities, motels, hotels, restaurants, fast food outlets, retail stores, maintenance garages, shopping centers, malls, grocery stores, temporary dwellings, portable dwellings, barrier walls, screen walls, planters, signage, demising walls, separation walls and other commercial structures. In both applications, the uses may be structural and non-structural. The integrated wall system can be manufactured in any size, height, configuration and shape; round, rectangle, square, hexagon, triangle, sloping in any other form that concrete can be shaped and integrated into a panel.

These and other advantages of the invention, as well as the details of an illustrative embodiment, will be more fully understood from the following specification and drawings.

DESCRIPTION OF THE PREFERRED EMBODIMENTS

Figure 1:
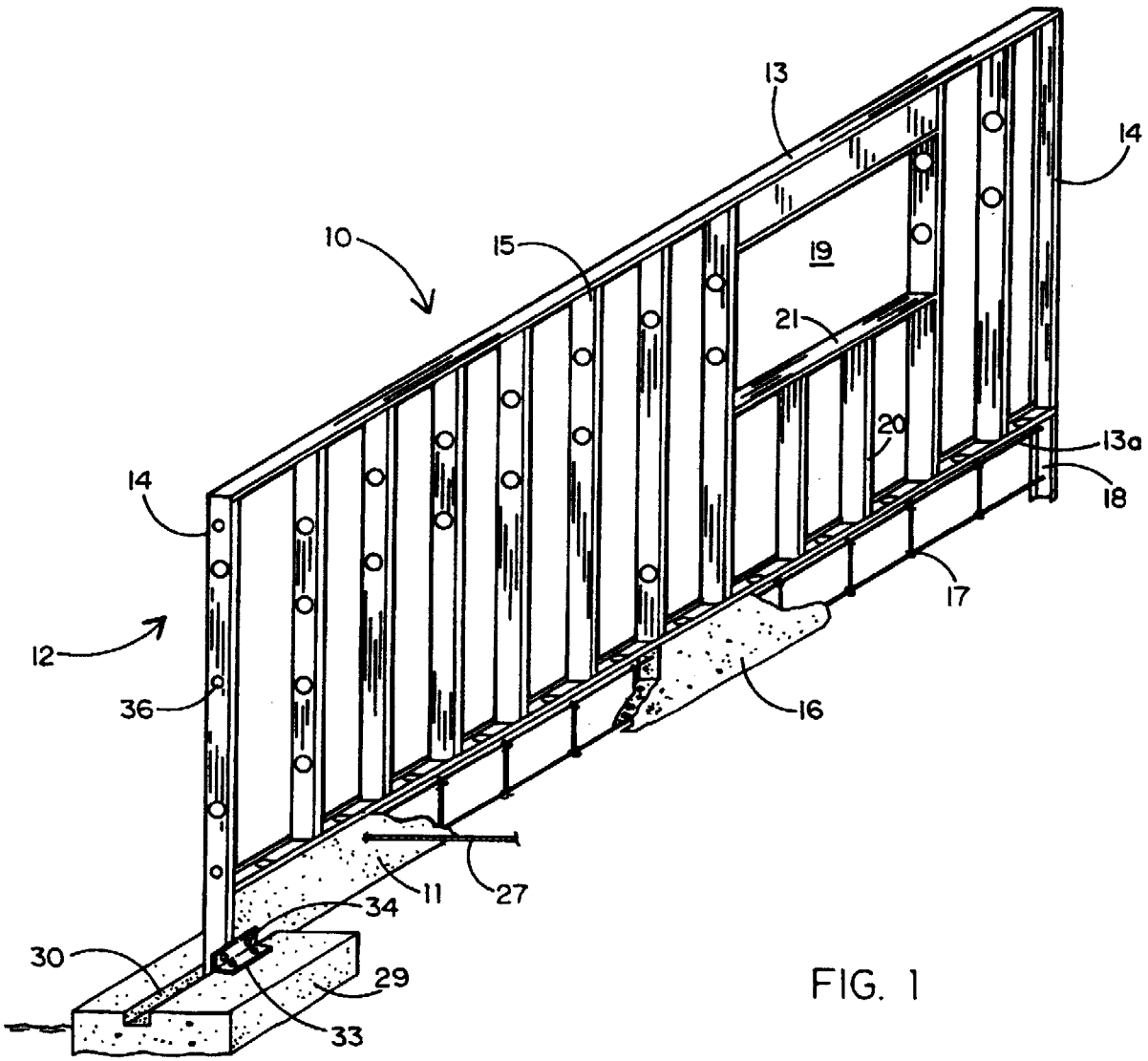
FIG. 1 is an isometric view of a typical panel, partially in section.

FIG. 1 illustrates an integrated wall panel 10 of the invention which generally comprises a reinforced Concrete stemwall 11 secured to a framing structure 12. Framing structure 12 comprises horizontal framing members 13 secured to vertical end studs 14. Intermediate vertical studs 15 are secured to horizontal framing members 13. The elements of the framing structure 12 are preferably welded together but may be secured to each other in any other suitable manner including, metallic screws, nuts and bolts or rivets. The horizontal framing member **13*a* borders the stemwall and is secured by any suitable means, including anchor bolts and nuts or other imbedded hardware. A mass of concrete 16 extends between end studs 14 and surrounds reinforcing means, such as horizontal and vertical reinforcing rods 17. The end studs 14 preferably are C-stud stock and are arranged so the channel 18 faces the stem wall. Concrete 16 extends into channel 18 to secure end studs 14 to stemwall 11. Other channel or cavity configurations in end studs 14 as well as additional securing means may be employed. Panel 10 is shown with a window opening 19, which is framed in a conventional manner with cripple studs 20 and sill 21. Other panels may have framed door openings, conduit channels or other openings or may have no framed opening at all. The proportion between the concrete 16, stemwall 11 and framing structure 12 can vary depending on the application and load requirement. The width, height and thickness of wall panel 10 vary depending on the design of the structure. A typical panel 10** is 11'-0" in height by 24'-0" long by '0-6" thick.

In other embodiments, the end studs 14 and any other bordering members of the framing structure 12 are secured to the reinforced concrete stemwall 11 by any combination of conventional means including post tension cables, vertical- and horizontal-through bolts, anchor bolts, other imbedded hardware and reinforcing steel configurations. For example, horizontal and vertical rods 17 may be welded to the framing structure 12. The reinforcing means for stemwall 11 may also include wire mesh, rebar or other conventional means. In a basic embodiment, panel 10 comprises end studs 14 secured to stemwall 11. Other framing members may be added as desired. Generally, horizontal framing members 13, intermediate studs 15 and any other framing members may be added to the end studs 14 before or after formation of stemwall 11 and before or after erection of the panel at the building site.

Figure 2:
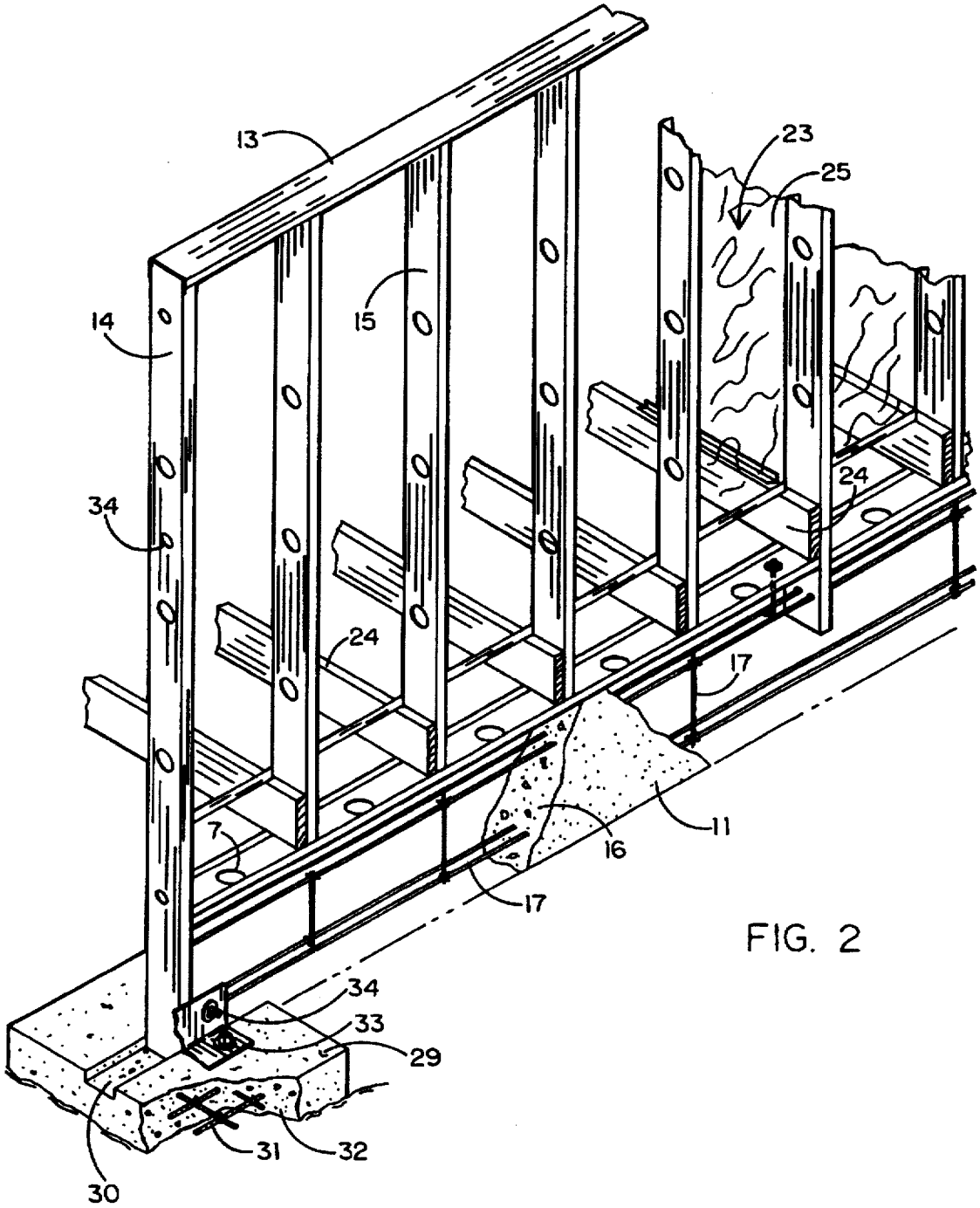
FIG. 2 is an enlarged partial isometric view of the FIG. 1 wall-panel taken from one end of panel and also showing a floor system.

The floor system for a building constructed with wall panels 10 may be of any suitable type. FIG. 2 illustrates a section of wall panel 10 with sub flooring system 23 which comprises a plurality of floor joists 24 secured to end studs 14 and intermediate studs 15. Plywood sheets 25 are secured to the joists 24 to form the subflooring. Generally, an 8'-0" clear space is provided from top of subfloor 23 to under side of ceiling at roof.

In the event a poured concrete floor is used, many different approaches are easily accomplished. As shown in FIG. 1, reinforcing rods 27 extend perpendicularly from stemwall 11. The reinforcing rods 27 may be placed and secured by coil inserts embedded in concrete 16 or by other suitable means and provide a connection between stemwall 11 and the concrete floor. The inside of the building can be backfilled with engineered fill to desired elevation relative to the concrete stemwall 11, generally slightly below the reinforcing rods 27. The concrete floor 26 is poured on the engineered fill and over the reinforcing rods 27 and conventionally finished to accept floor finishes.

Figure 3:
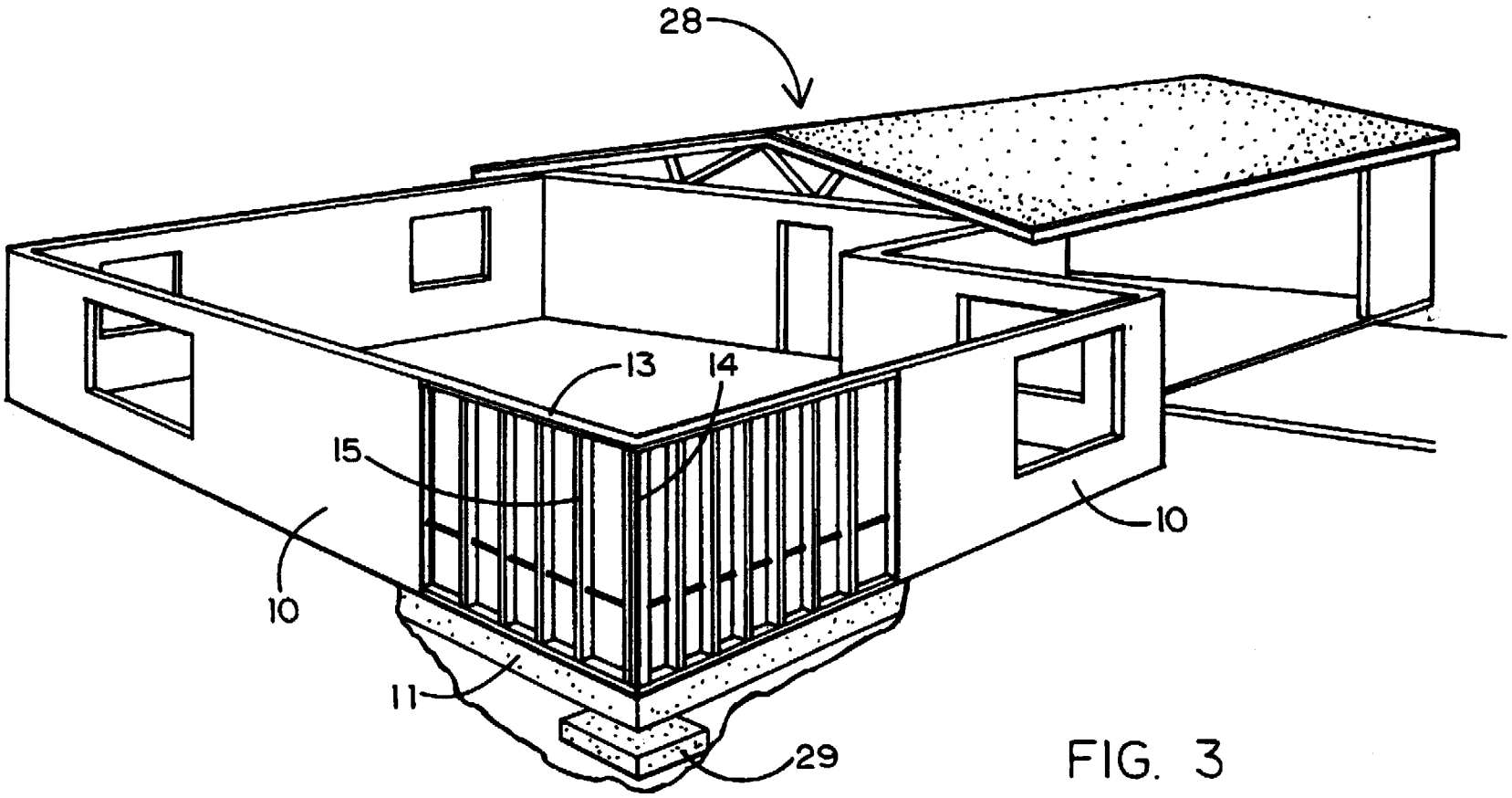
FIG. 3 is an isometric view of a panelized building using this invention.
Figure 4:
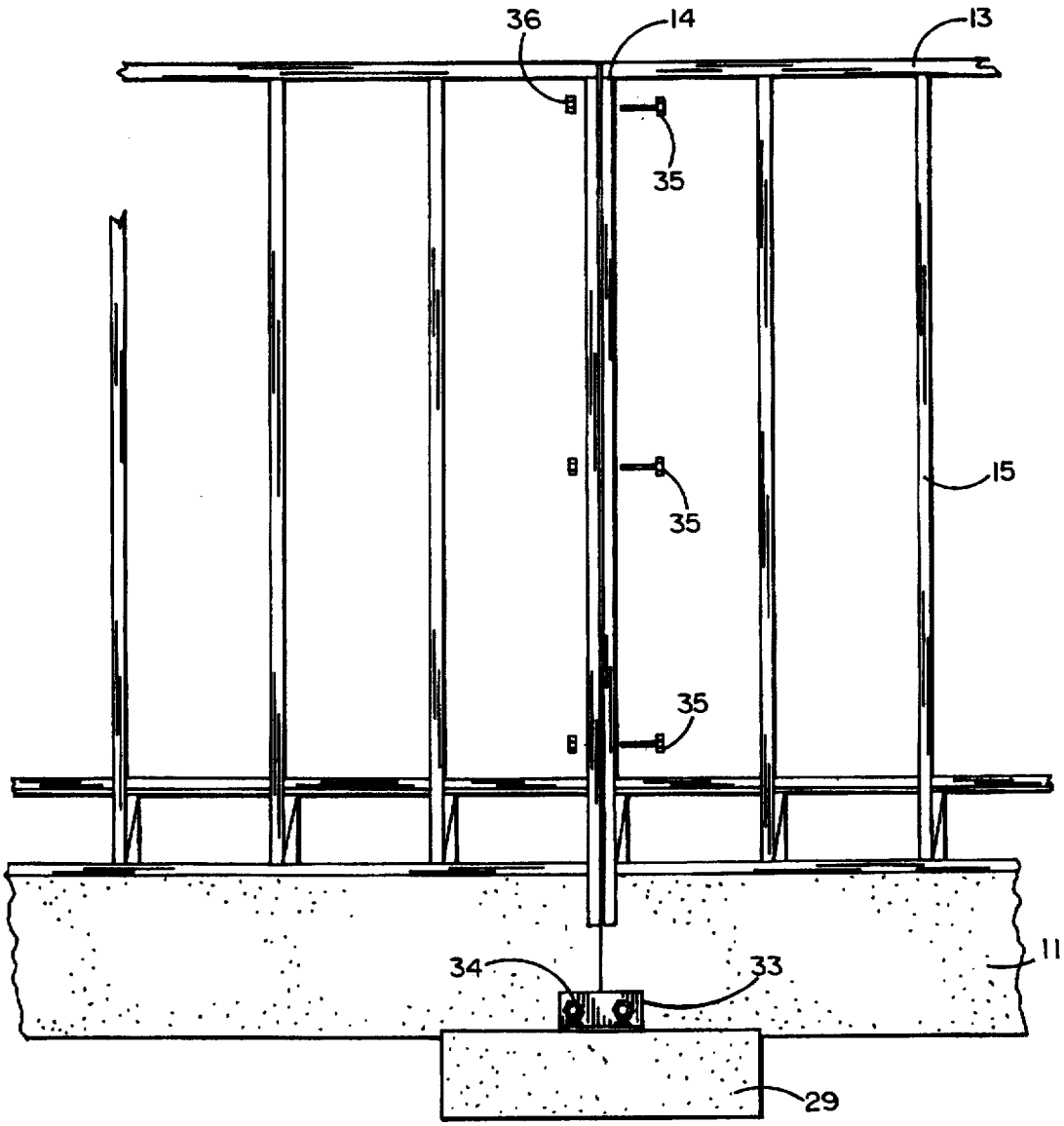
FIG. 4 is an isometric view at the joint connecting two panels and wall panel support pier.
Figure 5:
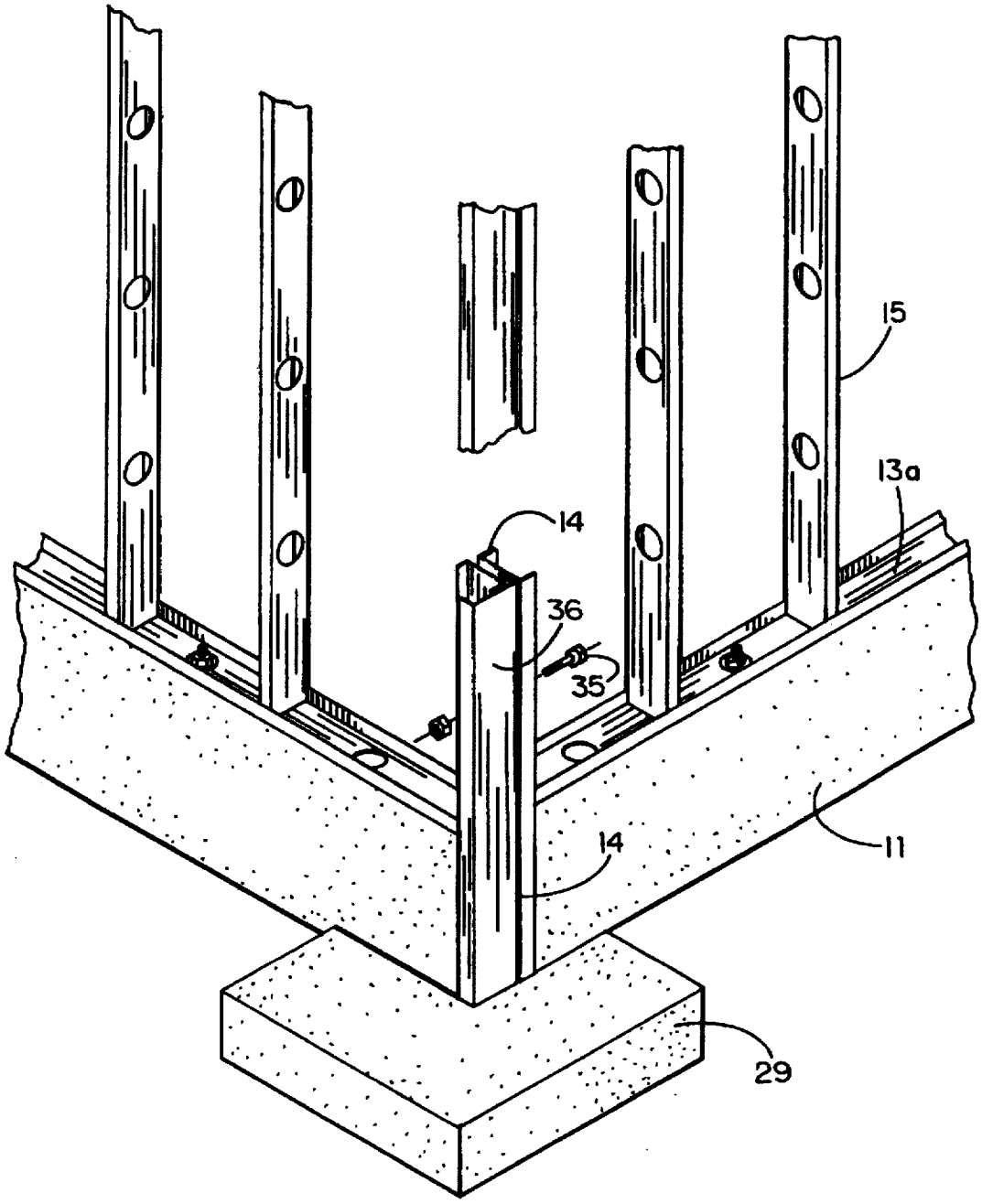
FIG. 5 is an isometric view at the corner joint connecting two panels and wall panel support pier.
Figure 6:
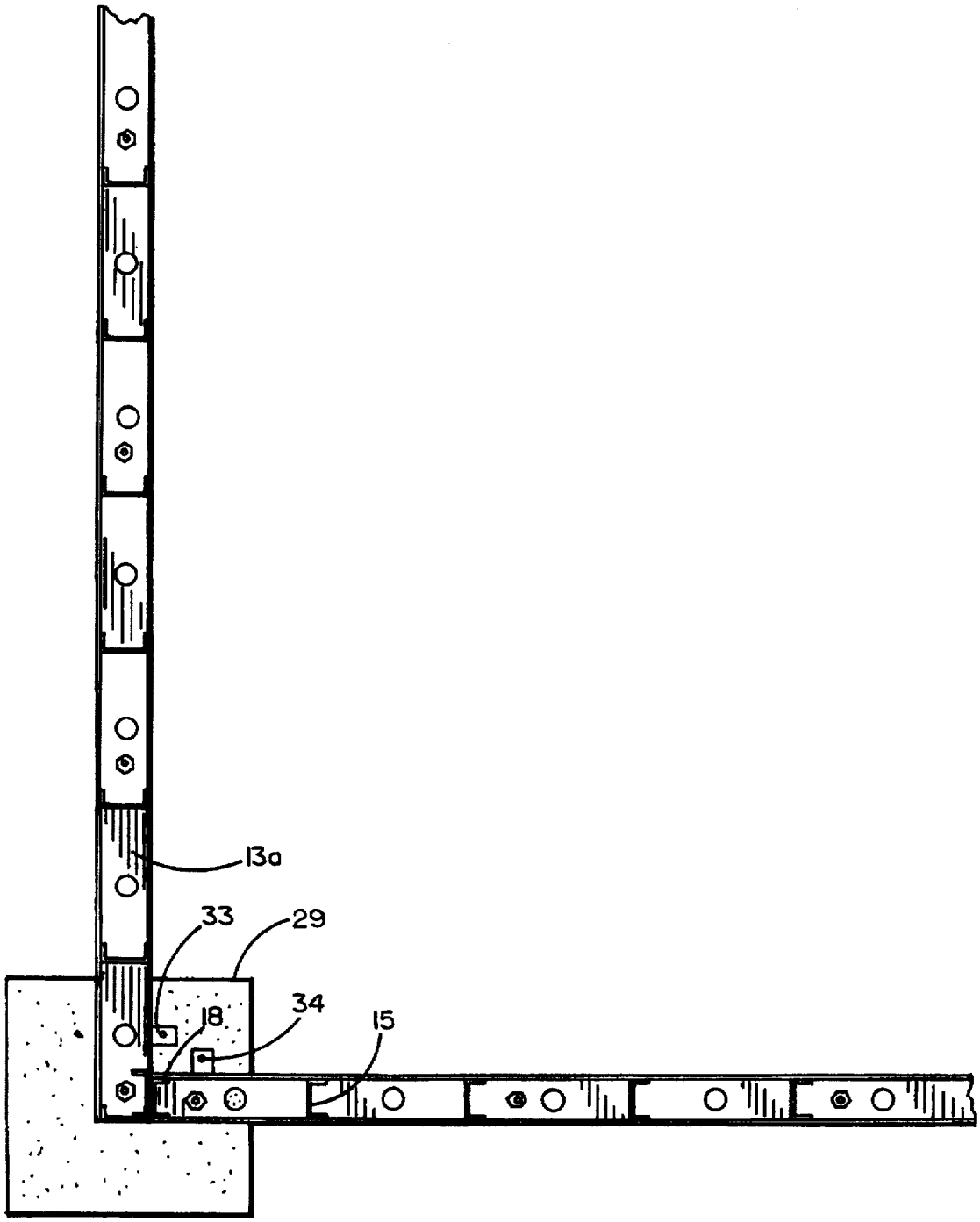
FIG. 6 is a cross sectional view of upper wall panels shown in FIG. 7.

As shown in FIG. 3 a building shell 28 may be constructed using panels 10 resting on support piers 29. Preferably, the support piers 29 are square having a key way 30 and comprise a metallic reinforcing network 31 inside a mass of poured concrete 32 as detailed in FIG. 2. The ends of panels 10 are secured to piers 29 in any conventional manner. For example, metallic angle plate 33 is fastened to pier 29 and stemwall 11 by metallic wedge bolt and nut assembly 34. The panels 10 are erected by a crane which places the panel 10 on the piers 29 and into the key ways 30. Prior to releasing panel 10 from crane, the panel 10 is braced in a vertical position by any suitable means. FIG. 4 shows adjacent panels 10 being secured by nut and bolt assemblies 35 through holes 36 at studs 14. FIGS. 5 and 6 show a typical corner connection. Other means of securing the panels are suitable. After all panels 10 have been set and bolted together and aligned, the metallic angle plate 33 is installed to secure the ends panels 10 to the piers 29.

Upon completion of floor system and roof system, construction joints at panels are caulked with water proof material from top to bottom of concrete stemwall 11 at the outside of panels 10. Then, the outside perimeter of panels 10 may be backfilled.

The wall panels 10 may be supported by piers 29 in any configuration, size, depth required and suitable to the application. The concrete stemwall 11 of panel 10 acts as a support beam which will span between piers 29. Soil conditions may require pier depths to be extended in depth for suitable support. This system is very compatible by spanning from pier to pier over unsuitable soil conditions. The panel system may also be adapted to other structures using a foundation and wall system with crawl space or slab on grade.

The construction of panels 10 is compatible with conventional building materials such as batt insulation that can be placed between studs 14 and 15, 4'-0" wide drywall, siding and the like attached to the studs. The surfaces of the studs 14 and 15 and the horizontal framing members 13 may be adjusted to provide a chase to below the floor line for plumbing, electrical, venting and the like. Interior parting walls within the building (not shown) are conventionally framed using metallic or wood framing members. Drywall is applied to inside of panel 10 and interior walls secured to framing members by conventional methods. Exterior wall finishes for panels 10 may be of any suitable materials such as wood siding, stucco or the like.

The panels of this invention can be built either at the building site or at a remote location depending on the conditions and costs. The concrete casting of the stemwall 11 may be done vertically or horizontally and onsite or offsite depending on the conditions and needs. Concrete can be placed by any available method such as pumping and tailgate from mixer track.

Figure 7:
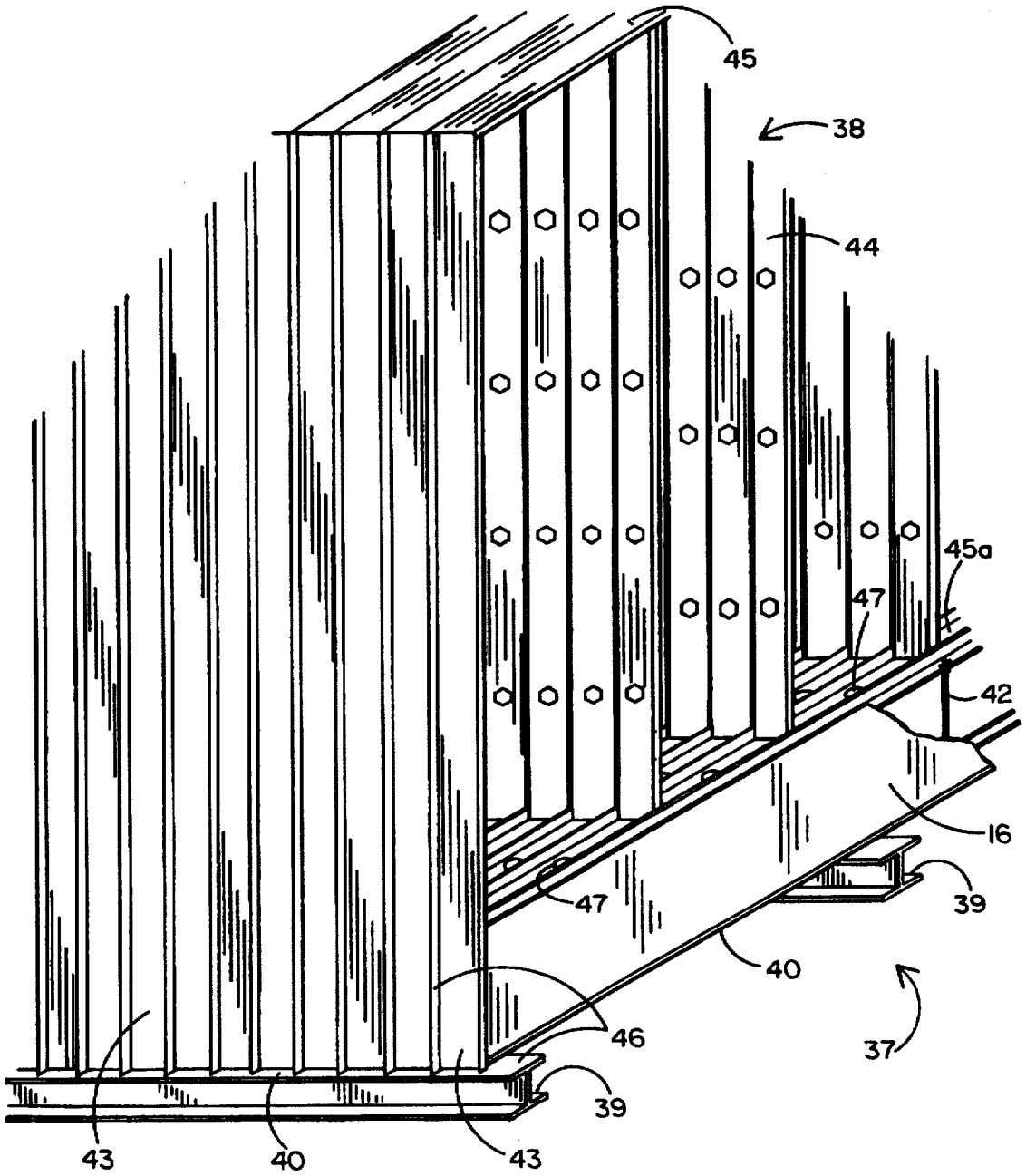
FIG. 7 is an isometric view of panels positioned vertically in the forming jig lower section of panel broken away for clarity.

A vertical forming jig 37 may be employed to cast a plurality of panels 38 as shown in FIG. 7. Jig 37 generally comprises a platform 39 with a plurality of horizontal forming members 40 secured to the platform 39 in a parallel arrangement. A framing structure 41 is positioned on each horizontal framing member 40. The framing structure 41 comprises reinforcing means 42 positioned between vertical end studs 43 and may also comprise intermediate studs 44 and horizontal framing members 45. Each horizontal forming member 40 is configured to receive the vertical end studs 43 of framing structures 41. The forming members 40, the end studs 41 and horizontal members 45*a*, if provided, comprise the boundary of each stemwall form. When placed in the jig 37, the framing structures 42 stand vertically and face each other. The forming members 40 are spaced apart a distance such that a planar forming spacer 46 can fit between adjacent framing structures 42 to define the sides of the stemwall form. Concrete 16 may then be deposited into the stemwall form to fill the form and surround reinforcing means 42. In embodiments where framing structure 41 has horizontal framing member 45*a* which comprises the upper boundary of the stemwall form, framing member 45*a* has a port 47 to allow concrete to be pumped into the stemwall form. If there is no horizontal framing member 45*a*, intermediate studs 43 may be secured directly to the concrete.

Wall panels 10 may be formed horizontally by placing several framing structures in a staggered flat position with the inside of the panel down, edge formed and filled with concrete. When concrete reaches specified strength for lifting, panels are then lifted onto a trailer for transporting to the site, and placed in position.

A general description of the device and method of using the present invention as well as a preferred embodiment of the present invention has been set forth above. One skilled in the art will recognize and be able to practice many changes in many aspects of the device and method described above, including variations which fall within the teachings of this invention. The spirit and scope of the invention should be limited only as set forth in the claims which follow.

What is claimed is:

1. A pre-formed integrated wall panel for building construction comprising a metallic framing structure having two spaced-apart vertical end studs with top and bottom ends and a reinforced concrete stemwall comprising a mass of concrete extending between and cast to a portion of the end studs.

2. The integrated wall panel of claim 1, wherein the end studs have a channel facing the stemwall and the reinforced concrete stemwall is cast into the channels to secure the end studs.

3. The integrated wall panel of claim 1, wherein the framing structure is secured to the stem wall by means selected from the group consisting of post tension cable, reinforcing steel, vertical-through bolts, horizontal-through bolts and anchor bolts.

4. The integrated wall panel of claim 1, further comprising reinforcing rods secured to the end studs and embedded in the stemwall.

5. The integrated wall panel of claim 1, further comprising a first horizontal framing member secured to and extending between the top ends of the end studs.

6. The integrated wall panel of claim 1, further comprising a plurality of intermediate vertical studs spaced between the end studs and extending from the stemwall.

7. The integrated wall panel of claim 1, further comprising a second horizontal framing member extending between the end studs and bordering the stemwall.

8. The integrated wall panel of claim 1, wherein the framing structure further comprises a framed opening selected from the group consisting of window opening, door opening and conduit opening.

9. The integrated wall panel of claim 6, wherein the end studs, the intermediate studs and the reinforced concrete stemwall are configured to secure floor joists.

10. The integrated wall panel of claim 1, wherein the reinforced concrete stemwall further comprises reinforcing rods configured to be incorporated in and support a poured concrete floor.

11. The integrated wall panel of claim 7, further comprising horizontal and vertical reinforcing rods secured to the end studs and the second horizontal framing member and embedded in the stemwall.

12. The integrated wall panel of claim 7, further comprising a first horizontal framing member secured to and extending between the top ends of the end studs and a plurality of intermediate vertical studs spaced between the end studs and extending between the first and the second horizontal framing members.

13. The integrated wall panel of claim 1, wherein the wall panel has an edge adjacent the bottom end of the end stud configured to fit a key way in a support pier.

14. A method for forming an integrated wall panel, comprising the steps of:

a) providing a framing structure with a front face and a rear face, comprising two vertical spaced-apart end studs having top and bottom ends;

b) providing reinforcing means between the end studs;

c) depositing liquid concrete between the end studs; and d) casting the concrete to the end studs to form a stemwall.

15. The method of claim 14, further comprising:

a) before depositing the concrete, providing a forming jig comprising a plurality of horizontal forming members in a parallel, spaced-apart configuration secured to a platform, wherein each horizontal forming member is configured to receive the bottom ends of a framing structure's end studs when the framing structure is placed vertically in the forming jig; and b) placing a plurality of framing structures in the horizontal forming members of the jig with a planar forming spacer adjacent the front face and the rear face of each framing structure to provide a stemwall form.

16. A method for constructing a building comprising the steps of:

a) providing a plurality of integrated wall panels having a length and opposing ends and comprising a metallic framing structure having two spaced-apart end studs and a reinforced concrete stemwall comprising a mass of concrete extending between and cast to a portion of the end studs;

b) providing a plurality of support piers comprising a mass of reinforced concrete;

c) setting the support piers in the ground;

d) placing the wall panels on the support piers such that the support piers support the ends of each panel;

e) securing the panels to the support piers; and f) securing adjacent panels to each other.

17. The method of claim 16 wherein the support piers further comprise a key way configured to receive the end of the wall panel and the step of placing the wall panels on the support piers further comprises the step of fitting the ends of the wall panels into the key ways.

18. A building comprising:

a) a plurality of support piers; and b) a plurality of integrated wall panels having a length and opposing ends and comprising a metallic framing structure having two spaced-apart vertical end studs with top and bottom ends and a reinforced concrete stemwall comprising a mass of concrete extending between and cast to a portion of the end studs, wherein each end of the wall panel is secured to a support pier and adjacent wall panels are secured to each other.

19. The building of claim 18, wherein the metallic framing structure of the integrated wall panels further comprising a plurality of horizontal framing members and intermediate vertical framing members secured to the end studs and the stemwall.

* * * * *